US008360399B2

(12) United States Patent
Lundrigan

(10) Patent No.: US 8,360,399 B2
(45) Date of Patent: Jan. 29, 2013

(54) MID-SPAN WINCH WITH A REEL-ENCLOSING SUPPORT FRAME

(76) Inventor: Brian E. Lundrigan, Conception Bay South (CA)

( * ) Notice: Subject to any disclaimer, the term of this patent is extended or adjusted under 35 U.S.C. 154(b) by 801 days.

(21) Appl. No.: 12/458,709

(22) Filed: Jul. 21, 2009

(65) Prior Publication Data

US 2010/0072443 A1 Mar. 25, 2010

Related U.S. Application Data

(60) Provisional application No. 61/083,652, filed on Jul. 25, 2008.

(51) Int. Cl.
*B66D 1/14* (2006.01)

(52) U.S. Cl. ..... 254/342; 254/329

(58) Field of Classification Search ..... 254/342, 254/329

See application file for complete search history.

(56) References Cited

U.S. PATENT DOCUMENTS

| | | | | | |
|---|---|---|---|---|---|
| 1,177,767 | A | | 4/1916 | Eggleston | |
| 1,547,963 | A | * | 7/1925 | Seifert | 254/342 |
| 1,806,606 | A | | 5/1931 | Booth | |
| 1,984,071 | A | * | 12/1934 | Liebreich | 254/329 |
| 2,378,749 | A | * | 6/1945 | Brown | 254/342 |
| 3,197,162 | A | | 7/1965 | Johanson et al. | |
| 3,307,494 | A | | 3/1967 | Samitz | |
| 3,322,398 | A | | 5/1967 | Smith | |
| 3,473,486 | A | | 10/1969 | Harmon | |
| 3,645,503 | A | * | 2/1972 | Doerfling | 242/157.1 |
| 3,653,606 | A | | 4/1972 | Sheets, Jr. | |
| 3,861,126 | A | | 1/1975 | Morrison | |
| 3,968,953 | A | * | 7/1976 | Guangorena | 254/342 |
| 4,196,889 | A | | 4/1980 | Dudek | |
| 4,552,340 | A | | 11/1985 | Sheppard | |
| 4,588,167 | A | | 5/1986 | Finzel | |
| 4,754,825 | A | | 7/1988 | Scheffer | |
| 5,002,259 | A | | 3/1991 | Manning | |
| 5,374,035 | A | | 12/1994 | Santos | |
| 5,603,489 | A | * | 2/1997 | Regal | 254/378 |
| 5,738,340 | A | | 4/1998 | Brantner | |
| 5,947,450 | A | | 9/1999 | Grapes | |
| 5,971,363 | A | | 10/1999 | Good | |
| 6,631,885 | B2 | | 10/2003 | Halas | |
| 6,726,182 | B2 | | 4/2004 | Topping, Jr. et al. | |
| 7,066,450 | B2 | | 6/2006 | Lundrigan | |
| 7,458,113 | B2 | | 12/2008 | Milam | |
| 7,686,282 | B2 | * | 3/2010 | Amoss et al. | 254/342 |
| 7,967,278 | B2 | * | 6/2011 | Anderson et al. | 254/356 |
| 2012/0068131 | A1 | * | 3/2012 | Latoria | 254/339 |

OTHER PUBLICATIONS

ATV Ratchet Winch, Black Max 6000, dated Oct. 16 2003. Published by NVG inc. 1 Laser Lane, Hazlehurst, GA, USA 31539.

ATV Pocket Winch, Mad Dog Gear Winch, dated 2008. Published by Kodiak Outback at http://www.kodiacoutback.com/.

* cited by examiner

*Primary Examiner* — Emmanuel M Marcelo
(74) *Attorney, Agent, or Firm* — Mario Theriault

(57) ABSTRACT

The mid-span winch has a support frame, a reel mounted in this support frame and a handle affixed to the support frame. The mid-span winch has a longitudinal axis extending horizontally from the reel and a vertical axis intersecting the longitudinal axis at a point on the reel. The handle is mounted to the support frame at a location on the support frame which is coincidental with the vertical axis. Wobbling and twisting motions in the winch body are thereby readily perceived with a true amplitude. A corrective action can then be applied to the winch body without using an excessive or a shy force. In another aspect of the present invention, the handle has a hand grip which extends obliquely from the longitudinal axis, whereby both a wobbling motion and a twisting motion on the winch body can be stabilized at once in a same grasp.

17 Claims, 2 Drawing Sheets

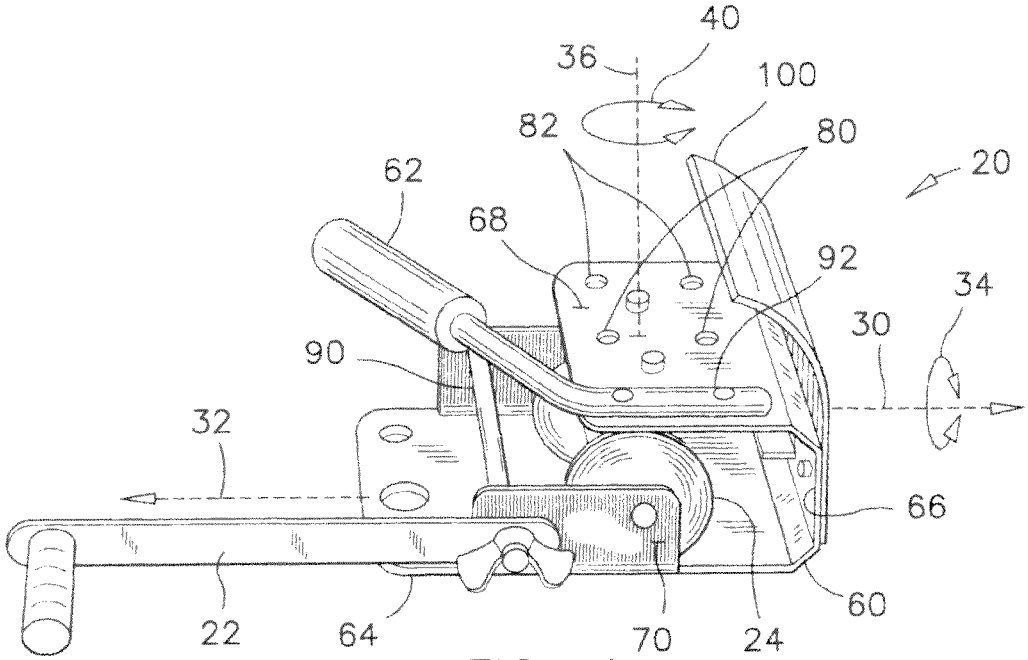
FIG. 1
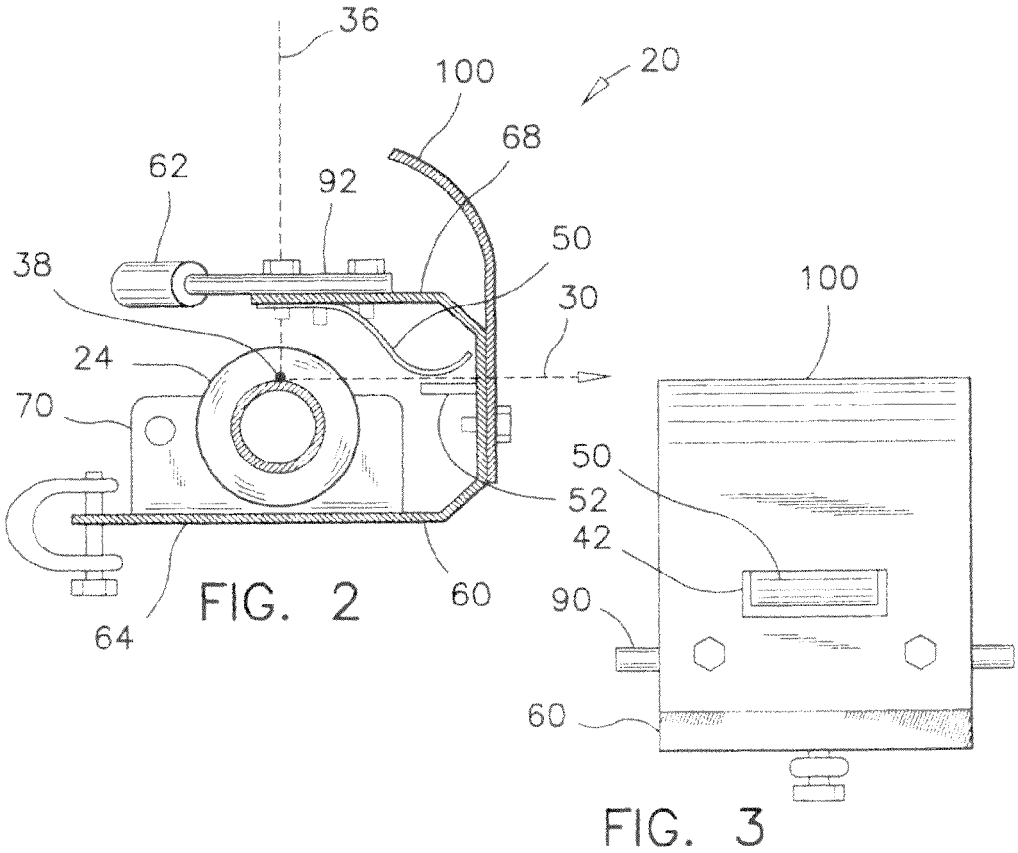
FIG. 2
FIG. 3

MID-SPAN WINCH WITH A REEL-ENCLOSING SUPPORT FRAME

This application claims the benefit of U.S. Provisional Application No. 61/083,652 filed Jul. 25, 2008.

This invention pertains to structures of mid-span winches, and more particularly, it pertains to a manual mid-span winch having a support structure enclosing the reel thereof.

BACKGROUND OF THE INVENTION

A mid-span winch is held between an anchor point and an object to be pulled toward the anchor point. A mid-span winch is usually held to the anchor point by a fixed-length strap, rope or cable and it has its retractable strap, rope or cable attached to the object to be moved. Of course, an opposite mounting can also work. The fixed-length strap, rope or cable is referred to hereinafter as the fixed-length towline, for convenience. Similarly, the retractable strap, rope or cable is referred to herein as the retractable towline.

In a manual mid-span winch, a hand crank operates the winch reel to wind the retractable towline and to pull the object toward the anchor point.

Unlike a common winch that is affixed to a solid structure, a manual mid-span winch is often suspended above ground to its fixed-length towline and retractable towline. A movement of the crank handle causes the mid-span winch to wobble back and forth from the axis of the towline, and to twist back and forth about the axis of the towline. An increase in tension in the towline reduces to some degrees the up and down movements of the winch. The side to side movements of the winch and the twisting of the winch about the pulling axis, however, remain substantially undiminished as tension increases. These wobbling and twisting movements cause significant difficulties in the operation of the crank handle and in the winding of the towline on the reel of the winch.

When a rope is used on the winch reel, the wobbling and twisting movements of the winch makes it difficult to wind the rope evenly, one layer at the time on the reel. In these cases, the rope tends to stack up at the ends of the reel.

When a strap is used as a towline, the wobbling and twisting motions of the winch body cause the strap to rub against the mouth of the winch and to fold over itself before it is wound on the reel. It will be appreciated by those using winches that both a rubbing of the strap edges against the mouth of the winch; the folding of the strap over itself, and the stacking up of a rope at the ends of a reel are undesirable defects in the operation of a winch, and can lead to precarious operation of the winch.

In order to appreciate the challenges associated with manual mid-span winches, two examples of manual mid-span winches of the prior art are listed herein below. These prior art manual mid-span winches belong to the same class as the manual mid-span winch described hereinafter.

U.S. Pat. No. 1,177,767 issued to R. N. Eggleston on Apr. 4, 1916. In this document, a crank-operated winch is described. The winch is used to pulled a car out of a mud-hole. The winch is suspended by chains between the car bumper and a series of conveniently-installed anchor spikes. The problems associated with the wobbling and twisting of the winch body in use have not been addressed in this publication. However, one can appreciate that the setup described therein is not easy to operate.

U.S. Pat. No. 1,806,606 issued to G. M. Booth on May 26, 1931. This document also discloses a mid-span winch with a hand-operated crank. An extensible leg prop has been provided under the winch body to secure the winch body to the ground when working the crank. The leg prop stabilizes the winch body against unwanted wobbling and twisting movements.

Although the leg prop in the last-mentioned document deserves some merits, there is still a need in the field of manual mid-span winches for a better way to counteract the wobbling and twisting actions of a winch body in use.

SUMMARY OF THE INVENTION

In the present invention, there is provided a manual mid-span winch which has a reel-enclosing support frame and a stabilizing handle affixed to this support plate. This support frame provides a support surface to attach a stabilizing handle to the winch body at a location at which a corrective action can be applied most effectively.

More precisely, there is provided a mid-span winch having a support frame, a reel mounted in this support frame and a handle affixed to the support frame. The mid-span winch has a longitudinal axis extending horizontally from the reel thereof and a vertical axis intersecting the longitudinal axis at a right angle, at a point on the reel. The handle is affixed to the support frame at a location on the support frame which is coincidental with the vertical axis of the winch. A motion in the winch body is thereby readily perceived with a true amplitude. A corrective action can then be applied to the winch body without using an excessive or a shy force.

In another aspect of the present invention, the handle has a hand grip which extends obliquely, and more preferably at about 45°, from the longitudinal axis of the winch whereby both a wobbling motion and a twisting motion on the winch body can be stabilized at once in a same grasp.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

A preferred embodiment of the present invention is illustrated in the accompanying drawings, in which like numerals denote like parts throughout the several views, and in which:

FIG. 1 is an isometric partial view of the preferred manual mid-span winch, with the hand crank and the stabilizing handle shown in a right-hand mounting;

FIG. 2 is a partial longitudinal cross-section view through the mid-span winch;

FIG. 3 is a front view of the mid-span winch;

DESCRIPTION OF THE PREFERRED EMBODIMENT

Figure 4:
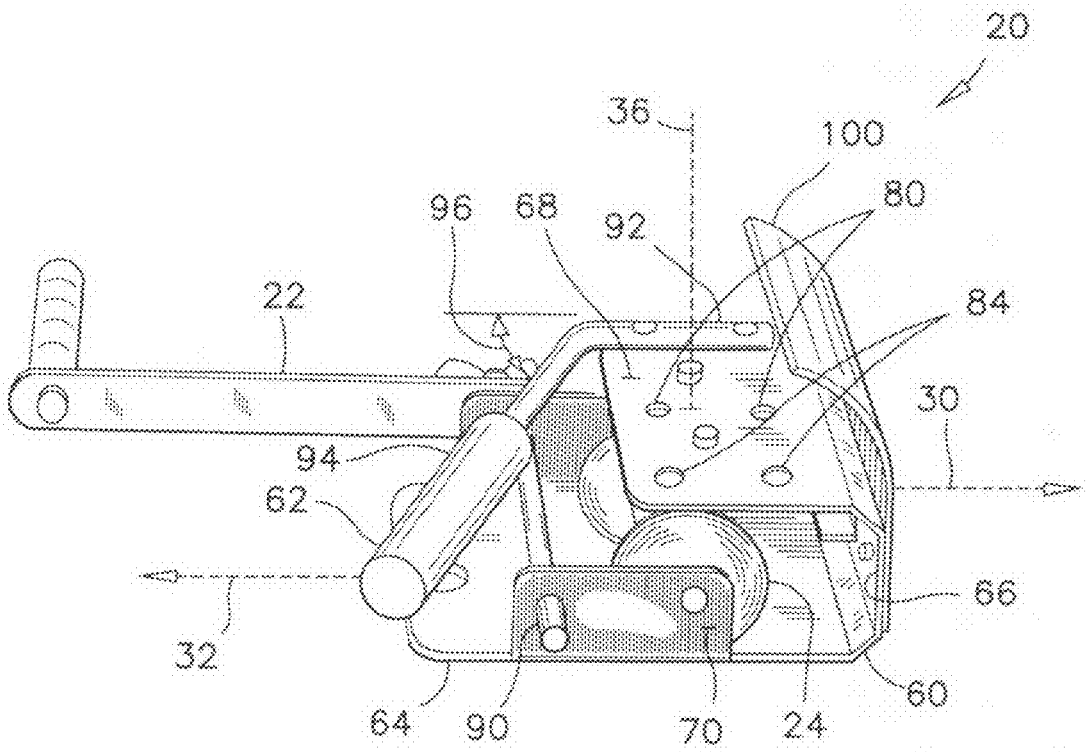
FIG. 4 is another isometric partial view of the preferred manual mid-span winch, with the crank handle and the stabilizing handle shown in a left-hand mounting.

Referring firstly to FIGS. 1-3, the typical movements of a mid-span winch in use will be explained. The mid-span winch 20 illustrated in these drawings is only partly drawn for clarity. The gear train or sprocket-and-chain mechanism joining the crank handle 22 to the reel 24 of the winch, in particular, has not been illustrated because this is not the focus of the present invention. Similarly, the fixed towline and the retractable towline have not been illustrated for being well known to those knowledgeable in this field.

Although a hand crank 22 is mentioned herein, the winch 20 can also be of the type using a reciprocating lever with a ratchet and pawl mechanism, and benefit from similar advantages as those described herein.

In FIG. 1, the dotted line 30 extending at the front of the winch 20 represents the longitudinal axis of the winch and the pulling axis of the retractable towline. The dotted line 32 extending at the rear of the winch 20 represents the axis of the fixed-length towline.

A twisting movement of the winch 20 in use is a movement back and forth about the longitudinal axis 30, in angular directions as shown by arrows 34.

The dotted line 36 extending upward from the reel 24 of the winch represents a vertical axis of the winch. The vertical axis 36 extends from a point 38 on the reel 24 where the axis of the retractable towline 30 is tangent to the reel 24. A wobbling movement of the winch 20 is defined as a back-and-forth movement about the vertical axis 36, as illustrated by arrows 40 in FIG. 1.

In use, a force on the crank handle 22 causes a twisting movement in the winch 20 in directions of arrows 34 and causes a wobbling movement of the winch 20 in directions of arrows 40. As mentioned earlier, these twisting and wobbling motions cause difficulties in the operation of the winch 20 in that the towline does not wind properly on the reel 24 or rubs against the mouth 42 of the winch and fold over itself before it reaches the reel 24.

Although a flex plate 50 and an anvil plate 52 are provided adjacent the mouth 42 of the winch 20 to prevent to some extent the folding over of a tow strap or the overlapping of a tow rope, significant difficulties still remain in the winding of the towline, due to the aforesaid wobbling and twisting movements of the winch.

In order to solve these difficulties, the support frame 60 of the preferred winch 20 is constructed to accommodate the mounting of a stabilizing handle 62 at strategic locations relative to the forces causing the twisting and wobbling movements of the winch body.

The support frame 60 has a toboggan-like shape with a base portion 64 extending under the reel 24; a front curved portion 66 enclosing the front portion of the reel 24, and a roof portion 68 extending over the reel 24. The reel 24 is pivoted to side plates 70 which are integral and folded up from the base portion 64, or otherwise extending from the base portion 64.

The roof portion 68 of the support frame 60 has mounting holes therein to which the flex plate 50 is attached. The roof portion 68 also has three series of holes for mounting the stabilizing handle 62 thereto.

The holes 80 in the first series of holes are aligned along the longitudinal axis 30 of the winch 20. When the stabilizing handle 62 is mounted to these holes 80, a wobbling movement along the vertical axis 36 is readily perceived along the handle 62. Because the handle 62 is attached to the winch at a point that is coincidental with the vertical axis 36 and because it extends radially from the vertical axis 36, in holes 80, this wobbling movement is readily perceived with a true amplitude. A rubbing of a tow strap against the sides of the mouth 42 of the winch or an overlapping of a rope on the reel 24 is also readily perceived because of this coincidental mounting of the handle 62 with the vertical axis 36.

Because the attachment point of the stabilizing handle 62 is close to or intersects the vertical axis 36, a force can be applied to the stabilizing handle 62 in a more direct manner than otherwise to correct a movement of the winch 20 to one side or to the other. The stabilizing handle 62 can also be used with more precision to facilitate an orderly spooling of a rope on the reel 24 or to facilitate a winding of a tow strap at the center of the reel 24.

A second and third sets of mounting holes 82, 84 are provided on the roof portion 68 of the support frame 60 for attachment of the stabilizing handle 62 to the support frame 60. These holes can be seen in FIG. 1 and FIG. 4 respectively.

Coming back to FIG. 1, the stabilizing handle 62 can also be mounted close to the crank handle 22 as shown, to better counteract the forces applied to the crank handle 22.

The preferred mid-span winch 20 has a drive shaft 90 in its mechanism. This drive shaft 90 extends on both sides of the winch 20 and has a handle-connector (not shown) on each end of the shaft 90 to mount the crank handle 22 to either side of the winch, for use of the winch by a right-handed or a left-handed person. A right-hand installation is shown in FIG. 1 and a left-hand installation is shown in FIG. 4.

In the left-hand installation, the stabilizing handle 62 is preferably affixed to the mounting holes 82 so that a stabilizing force can be applied close to the crank handle 22.

The preferred stabilizing handle 62 has a stem 92 that is affixed to the support plate and a hand grip 94 which extends obliquely from the support frame 60, and more preferably at an angle 96 of about 45° from the longitudinal axis 30 of the winch as shown in FIG. 4. This angle 92 has been found to be ideal for counteracting both the wobbling and twisting motions on the winch.

It will be appreciated, that the vertical axis 36 and the tangent point 38 moves along the reel 24 as the rope is wound on the reel 24. If a rope tends to stack up to the left end of the reel 24, the stabilizing handle 62 is preferably installed to the left hand set of holes 82 to better correct this tendency. Similarly if a rope tends to stack up to the right side of the reel 24 the stabilizing handle 62 is preferably mounted to the right-hand set of holes 84.

In another aspect of the preferred winch 20, a hand guard 100 is affixed to the front portion 66 of the support plate 60. The purpose of this guard 100 is to prevent hand injury to the user of the winch 20 in cases where the hook on the retractable tow line would get disengaged under tension from its load and be projected back toward the winch.

Figure 5:
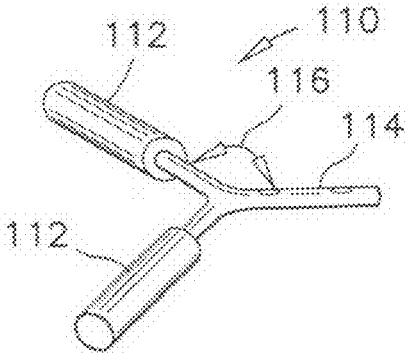
FIG. 5 is a first alternate stabilizing handle.
Figure 6:
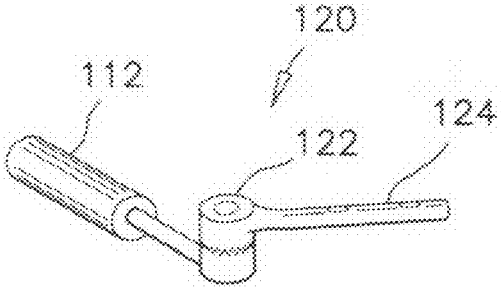
FIG. 6 is a second alternate stabilizing handle.

Referring now to FIGS. 5 and 6, there are shown therein two alternate stabilizing handles for use with the preferred winch 20. The first alternate handle 110 has Y shape with two hand grips 112 each extending obliquely, and more preferably at an angle 116 of 135°, from a common mounting stem 114. The second alternate handle 120 has an adjustable pivot 122 therein to adjust a hand grip 112 to a desired angle to one side or to the other of its mounting stem 124.

As to other manner of usage and operation of the preferred winch, the same should be apparent from the above description and accompanying drawings, and accordingly, further discussion relative to these aspects is deemed to be unnecessary.

What is claimed is:

1. A mid-span winch having a support frame, a reel mounted in said support frame; a handle affixed to said support frame; a longitudinal axis extending from said reel, and a vertical axis intersecting said longitudinal axis at a right angle at a point on said reel; said handle being affixed to said support frame at a location on said support frame that is coincidental with said vertical axis; said location being aligned with said longitudinal axis, and said handle having a hand grip extending obliquely from said longitudinal axis.

2. The mid-span winch as claimed in claim 1, wherein said support frame has a base portion extending under said reel, a curved front portion extending from said base portion in front of said reel and a roof portion extending from said front portion over said reel, and said reel being mounted to said base portion and said handle being mounted to said roof portion.

3. The mid-span winch as claimed in claim 2, further comprising a hand guard affixed to said curved front portion of said support frame.

4. The mid-span winch as claimed in claim 2 wherein said reel is supported to side plates extending from said base portion, said side plates being integral to and bent from said base portion.

5. The mid-span winch as claimed in claim 4 further comprising a shaft and a hand crank mounted to said shaft, and said roof portion has mounting holes therein for mounting said handle near said hand crank.

6. The mid-span winch as claimed in claim 5, wherein said shaft extends on both sides of said support frame, and said mounting holes comprise mounting holes for mounting said handle near either one of said both sides.

7. The mid-span winch as claimed in claim 1, wherein said handle has a stem affixed to said support frame and two hand grips each extending obliquely from said stem.

8. The mid-span winch as claimed in claim 1, wherein said handle has a stem affixed to said support frame, a hand grip, and an adjustable joint mounted between said hand grip and said stem.

9. A mid-span winch having a support frame, a reel mounted in said support frame, a handle affixed to said support frame; a towline extending from said reel and a longitudinal axis extending along said towline; said handle having a hand grip extending obliquely from said longitudinal axis.

10. The mid-span winch as claimed in claim 9, wherein said handle is mounted to said support frame at a location that is aligned with said longitudinal axis.

11. The mid-span winch as claimed in claim 10, further having a vertical axis intersecting said longitudinal axis at a right angle at a point on said reel where said towline is tangent to said reel; said handle is affixed to said support frame at a location on said support frame that is coincidental with said vertical axis.

12. The mid-span winch as claimed in claim 9, wherein said support frame has a base portion extending under said reel, a curved front portion extending from said base portion in front of said reel and a roof portion extending from said front portion over said reel, and said reel being mounted to said base portion and said handle being affixed to said roof portion.

13. The mid-span winch as claimed in claim 12, wherein said handle has a stem and two hand grips each extending obliquely from said stem.

14. The mid-span winch as claimed in claim 12, further comprising a hand guard affixed to said curved front portion of said support frame.

15. The mid-span winch as claimed in claim 14 wherein said reel is supported to side plates extending from said base portion, said side plates being integral to and bent from said base portion of said support frame.

16. The mid-span winch as claimed in claim 15 further comprising a shaft extending on both sides of said support frame, and a hand crank mountable to said shaft on either one of said both sides, and wherein said roof portion has mounting holes therein for mounting said handle near said either one of said both sides.

17. The mid-span winch as claimed in claim 9, wherein said handle comprises a stem; a hand grip, and an adjustable joint mounted between said hand grip and said stem.

* * * * *